US006474229B2

(12) United States Patent
Yano et al.

(10) Patent No.: US 6,474,229 B2
(45) **Date of Patent: *Nov. 5, 2002**

(54) MARKING DEVICE AND MARKING METHOD

(75) Inventors: Tetsuo Yano, Tokyo (JP); Yasunori Ohta, Tokyo (JP); Tetsuya Kudoh, Tokyo (JP)

(73) Assignee: Ando Electric Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/824,756

(22) Filed: Apr. 4, 2001

(65) Prior Publication Data

US 2001/0029849 A1 Oct. 18, 2001

(30) Foreign Application Priority Data

Apr. 18, 2000 (JP) ..... 2000-116836

(51) Int. Cl.[7] ..... B44C 1/24; B41F 17/00

(52) U.S. Cl. ..... 101/32; 101/3.1; 101/26; 101/4; 101/93.03; 400/124.01

(58) Field of Search ..... 101/3.1, 4, 18, 101/19, 20, 26, 28, 30, 32, 93.04, 93.03; 400/124.01, 124.02, 124.05, 127, 128, 135; 72/76

(56) References Cited

U.S. PATENT DOCUMENTS

| | | | | | |
|---|---|---|---|---|---|
| 1,860,729 | A | * | 5/1932 | Braund | 101/3.1 |
| 4,089,262 | A | * | 5/1978 | Sopora | 101/35 |
| 5,368,400 | A | * | 11/1994 | Cyphert et al. | 101/28 |
| 5,628,673 | A | | 5/1997 | Morooka | |
| 5,775,215 | A | * | 7/1998 | Hirate | 101/35 |

FOREIGN PATENT DOCUMENTS

| | | |
|---|---|---|
| DE | 39 32 549 A | 4/1990 |
| EP | 0 982 152 A2 | 3/2000 |
| JP | A 3-27397 | 2/1991 |
| JP | 3-27397 B2 * | 4/1991 |
| JP | 10-181292 | 7/1998 |

* cited by examiner

*Primary Examiner*—Leslie J. Evanisko
(74) *Attorney, Agent, or Firm*—Oliff & Berridge PLC

(57) ABSTRACT

A marking device includes a marking mechanism, a marking portion moving mechanism, and a pressure adjusting circuit. The marking mechanism marks a surface to be processed, of an object to be marked, by reciprocating a marking portion. The marking portion moving mechanism moves the marking portion in two-dimensional directions along the surface to be processed. The pressure adjusting circuit keeps a constant pressure which the marking portion applies to the surface to be processed. The marking mechanism includes a cam mechanism for linearly reciprocating the marking portion by following a cam which is rotated by a driving member.

10 Claims, 6 Drawing Sheets

MARKING DEVICE AND MARKING METHOD

BACKGROUND OF THE INVENTION

1. Field of the Invention

The present invention relates to a marking device and a marking method for marking a production number, a product name, or the like, on a surface of component made of metal, synthetic resin or the like.

2. Description of the Related Art

As a marking device according to an earlier development, which is disclosed in, for example, the Japanese Patent Publication No. Tokukou-hei 3-27397, a marking device having a pressure adjusting mechanism for making a marking depth uniform without depending on a slant or a curvature of a surface to be processed, by applying a constant air pressure to a pressurizing rod with a pressure regulator, has been known.

Further, there is a marking device which is operated as follows. When a line to be marked on a surface is not continuous or when a marking portion moves between two positions in which each character is marked on a surface, the marking portion is separated from the surface to be processed, by a reciprocating mechanism part. After the marking portion moves to the next marking position in two-dimensional directions, the marking portion moves to the surface to be processed, by the reciprocating mechanism part, to mark the next character.

However, in the marking device disclosed in the Japanese Patent Publication No. Tokukou-hei 3-27397, in order to keep the constant pressure to be applied to the pressurizing rod, it was necessary to adjust a moving speed of a pen which was attached to an end of the pressurizing rod and a pressing force of the pen by changing the pressure setting value of the pressure regulator by hand or by setting a velocity adjusting valve to an inlet or an outlet of a feed pipe for compressed air. Because it is necessary to adjust the pressure to be applied to the pressurizing rod in accordance with the characteristics of an object to be marked, such as material, shape, hardness and the like, it takes a lot of time and labor to adjust the pressure.

In order to automatically adjust the pressure, it is necessary to provide a pressure sensor for detecting a pressing force of the pen and to automatically adjust a velocity adjusting valve which is set to the inlet or the outlet of the feed pipe for compressed air and a pressure regulator. However, when the structure of the device becomes complicated and the size of the device becomes large, the product cost of the device becomes higher. Because the air for adjusting the pressure is compressed fluid, the air pressure control has a poor response. As a result, it is difficult to automatically control the air pressure.

Further, in case that a plurality of characters or the like are marked on the object, when a line to be marked is not continuous, or when the marking portion moves between two positions in which each character is marked, it takes a lot of time to separate the marking portion from the surface to be processed, or to bring the marking portion into contact with the surface to be processed. There is a problem that the separating and bringing operations account for much of the whole marking time.

SUMMARY OF THE INVENTION

In order to solve the above-described problems, an object of the present invention is to provide a marking device and a marking method, in which the pressing force to be applied to the object to be marked, can be automatically controlled by a cheap and simple structure, and in which time for moving the marking portion when a line to be marked is not continuous or when two characters are apart from each other, can be shortened in order to shorten the whole marking time.

That is, in accordance with one aspect of the present invention, a marking device (for example, a marking device 10 shown in FIG. 1) comprises:

- a marking mechanism (for example, a reciprocating mechanism part 1 shown in FIG. 1) for marking a surface to be processed, of an object to be marked, by reciprocating a marking portion (for example, a stylus 1*g* shown in FIG. 1):
- a marking portion moving mechanism (for example, a two-dimension positioning mechanism part 3 shown in FIG. 1) for moving the marking portion in two-dimensional directions along the surface to be processed; and
- a pressure adjusting circuit (for example, a pressure control circuit 2 shown in FIG. 1) for keeping a constant pressure which the marking portion applies to the surface to be processed;
- wherein the marking mechanism comprises a cam mechanism for linearly reciprocating the marking portion by following a cam which is rotated by a driving member (for example, a motor 1*a* shown in FIG. 1).

According to one aspect of the present invention, because the pressing force applied to the object to be marked is directly detected by utilizing the reactive force from the marking portion, and the pressing force can keep constant, the marking device can adjust the pressure with a simple and small structure.

The marking device may further comprise a contact detecting circuit (for example, a current detecting resistance 28 shown in FIG. 4) for detecting a contact between the surface to be processed and the marking portion by a change in a value of a current flowing into the driving member;

- wherein when the contact between the surface to be processed and the marking portion is detected by the contact detecting circuit, the pressure adjusting circuit (for example, a pressure control circuit 2 shown in FIG. 1) adjusts the pressure which is applied to the surface to be processed, in accordance with the change in the value of the current.

Therefore, the marking device can mark a character or the like on the object to be marked, by moving the marking portion at the most suitable speed and with the most suitable pressing force in accordance with the weight of the marking mechanism or the contact position of the surface to be processed.

In accordance with another aspect of the present invention, a marking method comprises the steps of:

- marking a surface to be processed, of an object to be marked, by following a cam which is rotated by a driving member to reciprocate a marking portion;
- moving the marking portion in two-dimensional directions along the surface to be processed;
- detecting a contact between the surface to be processed and the marking portion by a change in a value of a current flowing into the driving member; and
- keeping a constant pressure which the marking portion applies to the surface to be processed in accordance with the change in the value of the current, when the contact between the surface to be processed and the marking portion is detected in the detecting step.

The marking device may further comprise a warning output circuit (for example, an amplifier 29 shown in FIG. 4) for outputting a warning when the contact between the surface to be processed and the marking portion is not detected by the contact detecting circuit while the marking mechanism (for example, a reciprocating mechanism part 1 shown in FIG. 1) linearly reciprocates the marking portion.

The marking method may further comprise a step of outputting a warning when the contact between the surface to be processed and the marking portion is not detected in the detecting step while the marking portion is linearly reciprocated in the marking step.

Because a user can soon recognize that the marking mechanism is in a position that the marking portion cannot mark a character or the like on the object to be marked, it is possible to shorten marking time and to save the power.

The marking mechanism (for example, a reciprocating mechanism part 1 shown in FIG. 1) may comprise a cam having a cam curvature so that a torque which is applied to the driving member by the contact between the marking portion and the surface to be processed, is kept constant without depending on a position of the contact of the surface to be processed.

Because the torque applied to the driving member keeps constant, it is possible to mark a character or the like in a uniform depth without depending on the contact position that the marking portion is in contact with the surface to be processed.

In accordance with another aspect of the present invention, a marking device (for example, a marking device 10 shown in FIG. 1) comprises:

a marking mechanism (for example, a reciprocating mechanism part 1 shown in FIG. 1) for marking a surface to be processed, of an object to be marked, by reciprocating a marking portion (for example, a stylus 1*g* shown in FIG. 1) of which an end is vibrated;

a marking portion moving mechanism (for example, a two-dimension positioning mechanism part 3 shown in FIG. 1) for moving the marking portion in two-dimensional directions along the surface to be processed; and a pressure adjusting circuit (for example, a pressure control circuit 2 shown in FIG. 1) for keeping a constant pressure which the marking portion applies to the surface to be processed;

wherein the pressure adjusting circuit weakens the pressure which is applied to the surface to be processed, and stops vibrating the end of the marking portion, when a line to be marked is not continuous or when the marking portion moves between two positions in which each character is marked on the surface to be marked; and the marking portion moving mechanism moves the marking portion to a next position to be marked in the two-dimensional directions.

In accordance with another aspect of the present invention, a marking method comprises the steps of:

marking a surface to be processed, of an object to be marked, by reciprocating a marking portion of which an end is vibrated;

weakening a pressure which is applied to the surface to be processed, to keep the pressure constant, and stopping vibrating the end of the marking portion, when a line to be marked is not continuous or when the marking portion moves between two positions in which each character is marked on the surface to be marked; and moving the marking portion to a next position to be marked in two-dimensional directions.

According to another aspect of the present invention, when a line to be marked is not continuous, or when the marking portion moves between two positions in which each character is marked, the marking portion hardly reciprocates. Therefore, it is possible to dramatically shorten time for the marking. Further, because time for operating the marking mechanism is shortened, it is possible to improve the durability of the marking mechanism. Therefore, the possibility of the breakdown can be improved.

In accordance with another aspect of the present invention, a marking device comprises:

a marking portion moving mechanism for moving a marking portion;

a reciprocating mechanism for reciprocating the marking portion;

a pressure control circuit for controlling a pressure which a marking portion applies to a surface to be marked; and wherein when the marking portion moving mechanism moves the marking portion without marking the surface to be marked, the reciprocating mechanism stops reciprocating the marking portion, the pressure control circuit weakens the pressure so as to hardly mark the surface to be marked, and the marking portion is moved along the surface to be marked.

In accordance with another aspect of the present invention, a marking method comprises the steps of:

moving a marking portion;

reciprocating the marking portion;

controlling a pressure which a marking portion applies to a surface to be marked; and wherein when the marking portion is moved without marking the surface to be marked, the marking portion stops being reciprocated, the pressure is weakened so as to hardly mark the surface to be marked, and the marking portion is moved along the surface to be marked.

BRIEF DESCRIPTION OF THE DRAWINGS

The present invention will become more fully understood from the detailed description given hereinbelow and the accompanying drawings which are given by way of illustration only, and thus are not intended as a definition of the limits of the present invention, and wherein.

PREFERRED EMBODIMENT OF THE INVENTION

First Embodiment

Hereinafter, the first embodiment of the marking device according to the present invention will be explained in detail with reference to FIGS. 1 to 4.

The construction of the marking device will be explained.

Figure 1:
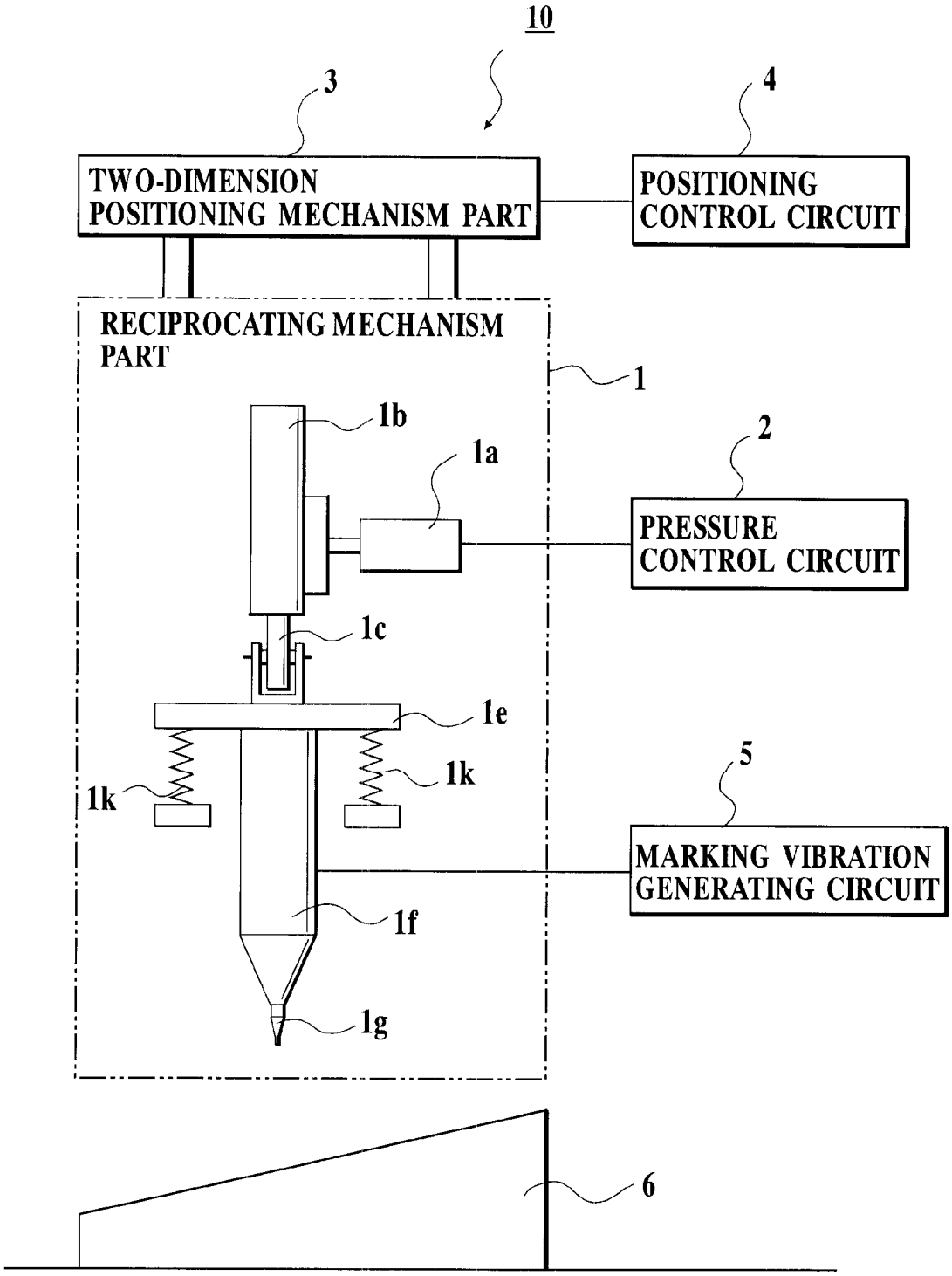
FIG. 1 is a view showing a schematic construction of the marking device according to the first embodiment to which the present invent on is applied.

FIG. 1 is a view showing a schematic construction of a marking device 10 according to the first embodiment to which the present invention is applied.

Figure 2:
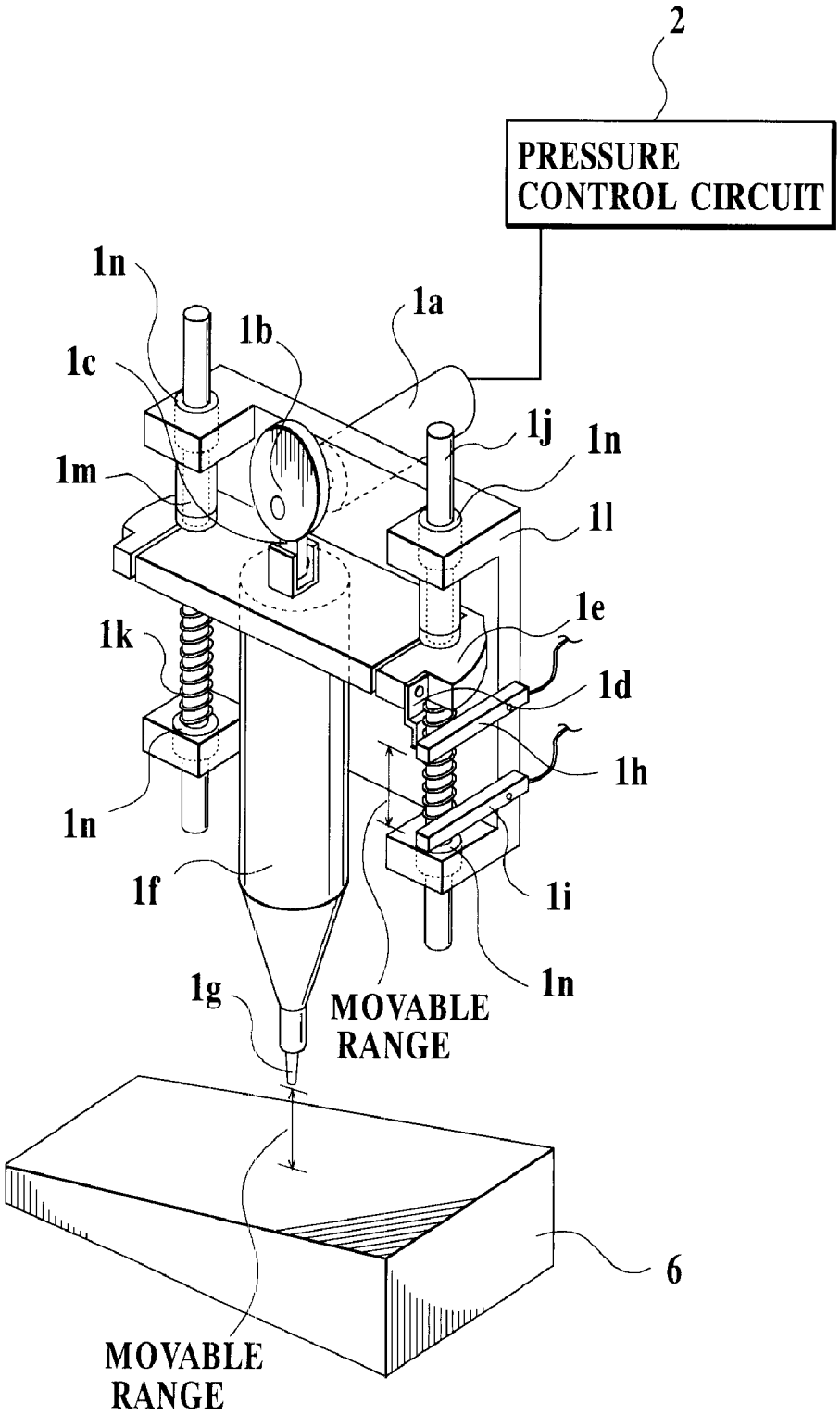
FIG. 2 is a schematic perspective view of the reciprocating mechanism part shown in FIG. 1.

In FIG. 1, the marking device 10 comprises a reciprocating mechanism part 1, a pressure control circuit 2, a two-dimension positioning mechanism part 3, a positioning control circuit 4 and a marking vibration generating circuit 5. As shown in FIG. 2, the reciprocating mechanism part 1 comprises a motor 1*a*, a cam 1*b*, a cam follower 1*c*, a dog 1*d*, a holding portion 1*e*, a pen 1*f*, a stylus 1*g*, a moving up limit detecting portion 1*h*, a moving down limit detecting portion 1*i*, two shafts 1*j* and 1*j*, a coil spring 1*k*, a fixing plate 11, a stopper 1*m*, four bearings 1*n* and the like.

The motor 1*a* is attached to the fixing plate 11. When the motor 1*a* drives to rotate the cam 1*b*, the holding portion 1*e* moves linearly via the cam follower 1*c*. The holding portion 1*e* is fixed to two shafts 1*j* and 1*j*, and is always pressed to the cam 1*b* side by the coil spring 1*k*. Therefore, even though the holding portion 1*e* is pressed down to the object 6 to be marked, by rotating the cam 1*b*, or even though the holding portion 1*e* is separated from the object 6 to be marked, the holding portion 1*e* is movable by following the cam 1*b*.

The cam 1*b* has a shape so that the stylus 1*g* attached to the end portion of the pen 1*f* can be pressed to the object 6 to be marked under a constant pressure generated by a constant torque of the motor 1*a* without depending on a rotating position of the cam 1*b* within the movable range of the stylus 1*g*. The stylus 1*g* is made of a material having a higher hardness than that of the object 6 to be marked. The stylus 1*g* repeatedly marks a plurality of dots on the object 6 to be marked, by vibrating the stylus 1*g* in a upper and lower direction at a high speed.

The bearings 1*n* are incorporated into the fixing plate 11. The shafts 1*j* and 1*j* move linearly by being guided by the bearings 1*n*. The cam follower 1*c* and the pen 1*f* are attached to the holding portion 1*e*. The moving up limit detecting portion 1*h* detects the dog 1*d* when the end of the pen 1*f* attached to the bottom surface of the holding portion 1*e* is in a moving up limit position, that is, the position that the pen 1*f* cannot move up any more. The moving down limit detecting portion 1*i* detects the dog 1*d* when the end of the pen 1*f* is in a moving down limit position, that is, the position that the pen 1*f* cannot move down any more.

The pressure control circuit 2 controls the speed of the reciprocating motion of the pen 1*f* by controlling the rotation speed of the motor 1*a* as described below. When the pen 1*f* is in contact with the object 6 to be marked during the reciprocating motion of the pen 1*f*, the pressure control circuit 2 detects that the pen 1*f* reaches the object 6 to be marked. After the pen 1*f* is in contact with the object 6 to be marked, the pressure control circuit 2 control the pressure which the pen 1*f* applies to the object 6 to be marked, so as to have a constant value. When the stylus 1*g* reaches the moving down limit position without contacting with the object 6 to be marked, the motor 1*a* rotates reversely. When the stylus 1*g* reaches the moving up limit position, the motor 1*a* stops and a warning is given to a user.

The two-dimension positioning mechanism part 3 positions a two-dimensional pattern, such as, a character, a number, or the like, in a direction normal to a marking axis, in accordance with a positioning signal outputted from the positioning control circuit 4. The reciprocating mechanism part 1 brings the pen 1*f* into contact with the object 6 to be marked, in a state of vibrating the pen 1*f*. A character or a number is marked on the object 6 to be marked. The marking vibration generating circuit 5 gives a vibration to the pen 1*f*.

The operation of the marking device 10 will be explained below.

Figure 3:
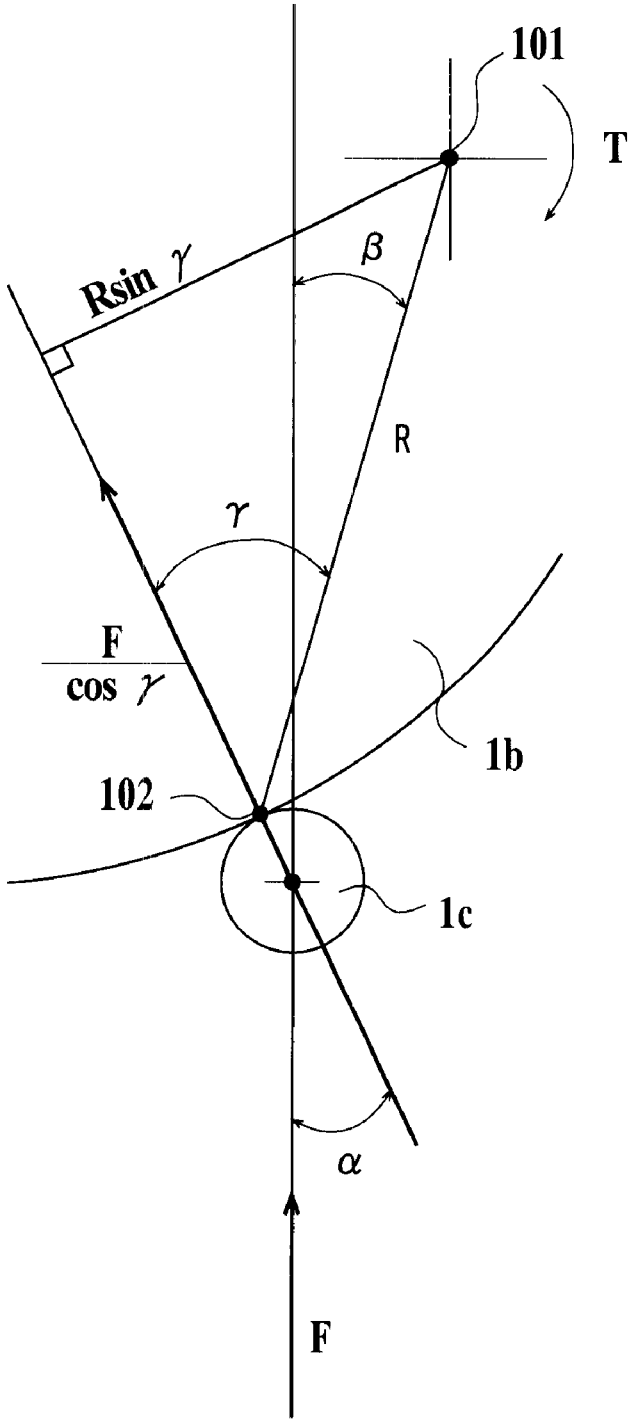
FIG. 3 is a view showing a dynamical relation between the cam and the cam follower shown in FIG. 1.

As shown in FIG. 3, a dynamical system of the cam mechanism will be explained. In FIG. 3, the reference numeral 101 denotes a support of the cam 1*b* which is a rotation shaft of the motor 1*a*, and 102 denotes a contact point between the cam 1*b* and the cam follower 1*c*. The reference "R" denotes a distance between the support 101 and the contact point 102, "F" denotes a reactive force from the object 6 to be marked, and "T" denotes a torque produced by the reactive force "F" at the support 101. The reference "α" denotes an angle between the reactive force "F" direction and a direction that a reaction force of the cam follower 1*c* is applied to the cam 1*b*, "β" denotes an angle between the reactive force "F" direction and the distance "R" direction, and "γ" denotes an angle between the reactive force "F" direction and a force "F/(cos α)" direction.

The torque "T" generated by the reactive force "F" from the object 6 to be marked, at the support 101 is determined by a resultant force "F/(cos α)" between a reactive force from a mechanism part for regulating the central shaft of the cam follower 1*c* to a linear motion and the reactive force "F", and a distance "R sin γ" between the support 101 and the line that the regulated central shaft moves. These factors have the following relations.

$$T=(F/\cos\alpha)\times R\sin\gamma \quad (1)$$

$$\gamma=\alpha+\beta \quad (2)$$

In these equations, in case that each predetermined value is given to the reactive force "F" and the torque "T", each initial value of the distance "R" and the angles "α" and "β" is determined by considering a suitable component arrangement within the movable range of the pen 1*f*. In this case, because the angle "α" hardly changes by changing each position of the components within the movable range, the relation between the distance "R" and the angle "β" can be determined by the equation (1). Thereby, a cam curvature that the reactive force "F" and the torque "T" are constant, can be obtained.

Therefore, a pressure which is applied to the object 6 to be marked when a constant torque is applied to the cam 1*b* by the motor 1*a*, can keep constant by suitably changing the distance between the support and the contact point in accordance with the rotation of the cam 1*b* having a curvature form which satisfies the above equations. Precisely, the reactive force "F" is changed in accordance with the change of a length of the coil spring 1*k*. However, the change of the reactive force "F" is much smaller than the pressure to be applied to the object 6 to be marked. Therefore, the change of the reactive force "F" can be ignored.

Figure 4:
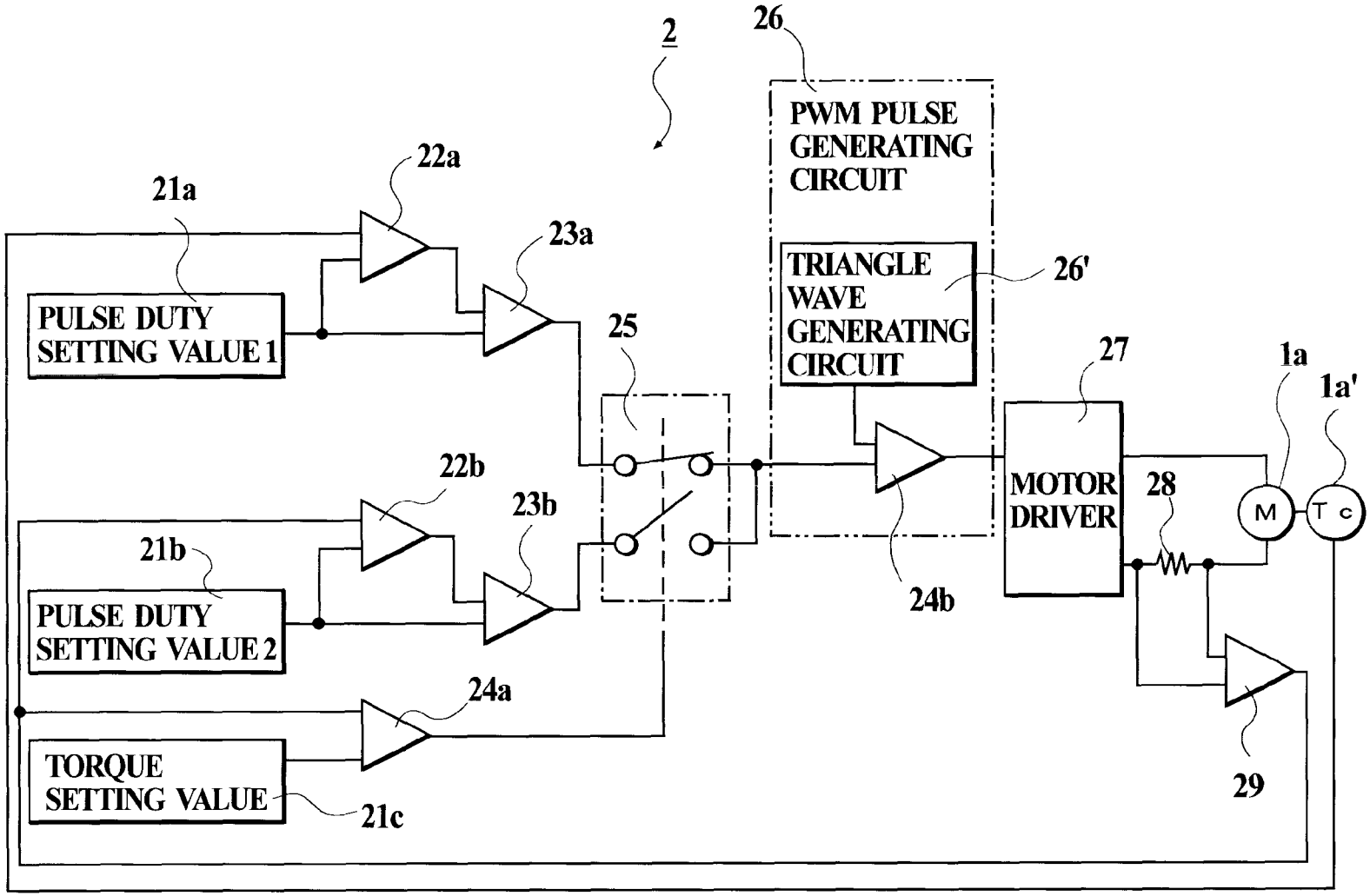
FIG. 4 is a block diagram showing a construction of the pressure control circuit according to the first embodiment, which is shown in FIG. 1.

The operation of the pressure control circuit 2 will be explained with reference to FIG. 4. The speed control method for the pen 1*f* will be explained.

The rotation speed of the motor 1*a* is detected by attaching a tachometer 1*a*' to the motor 1*a*. By a subtracter 22*a* and an adder 23*a*, a difference between the value obtained by detecting the rotation speed of the motor 1*a* and a pulse duty setting value stored in a pulse duty setting unit 21*a*, is added to the above pulse duty setting value in order to generate a signal having the added value.

A switch 25 outputs the generated signal to a comparator 24*a* in order to generate a comparative signal for comparing the generated signal with a triangle wave outputted from the triangle wave generating circuit 26' of the PWM pulse generating circuit 26. Thereby, the rotation speed of the motor 1*a* is controlled so that the output signal of the tachometer 1*a*' maintains the predetermined value set by the pulse duty setting unit 21*a*. By the above-described operation, the pressure control circuit 2 can control the reciprocating motion of the pen 1*f* at an optional speed.

The method for detecting that the pen 1*f* reaches the object 6 to be marked will be explained.

When a DC servo motor is used as a motor 1*a*, a current value of the DC servo motor is proportional to the torque. However, when the stylus 1*g* is in contact with the object 6 to be marked, the motion of the pen 1*f* is stopped. Therefore, the torque of the motor 1*a* is temporarily excessive. The voltage of both ends of a current detecting resistance 28 is detected by inputting the voltage into an amplifier 29. Then, the comparator 24*a* compares the detected voltage with a torque setting value which is previously stored in a torque setting unit 21*c*, in order to detect that the pen 1*f* reaches the object 6 to be marked. When it is not detected that the pen 1*f* reaches the object 6 to be marked, the amplifier 29 stops the motor 1*a* and a warning is given to a user. By the above-described operation, the pressure control circuit 2 can detect that the pen 1*f* is in contact with the object 6 to be marked, during the reciprocating motion of the pen 1*f*.

The method for controlling a pressure to be applied to the pen 1*f* will be explained.

A subtracter 22*b* compares an output value of the amplifier 29, which is a signal proportional to the torque "T", with a pulse duty setting value which is stored in a pulse duty setting unit 21*b*, and outputs a difference between the output value of the amplifier 29 and the pulse duty setting value of the pulse duty setting unit 21*b*. An adder 23*b* generates a signal having a value obtained by adding the above difference to the pulse duty setting value.

The switch 25 outputs the generated signal to a comparator 24*b* in order to generate a comparative signal for comparing the generated signal with a triangle wave outputted from the triangle wave generating circuit 26' of the PWM pulse generating circuit 26. Thereby, the torque of the motor 1*a* is controlled through a motor driver 27 so that the output signal of the amplifier 29 is equal to the pulse duty setting value which is previously set by the pulse duty setting unit 21*b*. By the above-described operation, the pressure control circuit 2 can control the pressure which the pen 1*f* applies to the object 6 to be marked, so as to have a constant value.

As described above, because the pressure control circuit 2 controls the switch 25 in accordance with the signal for detecting that the pen 1*f* reaches the object 6 to be marked, the difference in weight between one type of pen and another type does not influence the strength of the impact on the object 6 to be marked. Various types of pen can be used. Further, it is possible to control the speed of the pen 1*f* and the pressure which the pen 1*f* applies to the object 6 to be marked, so that the pressing force of the stylus 1*g* has the most suitable value. Therefore, the marking device for uniformly marking a character or the like on a surface to be processed, without depending on a material or a shape of the object 6 to be marked, can be constructed cheaply and simply.

Second Embodiment

Hereinafter, the second embodiment of the marking device according to the present invention will be explained.

The construction of the marking device will be explained.

The schematic construction of the marking device according to the second embodiment to which the present invention is applied, is approximately the same as that of the marking device 10 (shown in FIG. 1) according to the first embodiment. The drawings and the explanation thereof are omitted.

Figure 5:
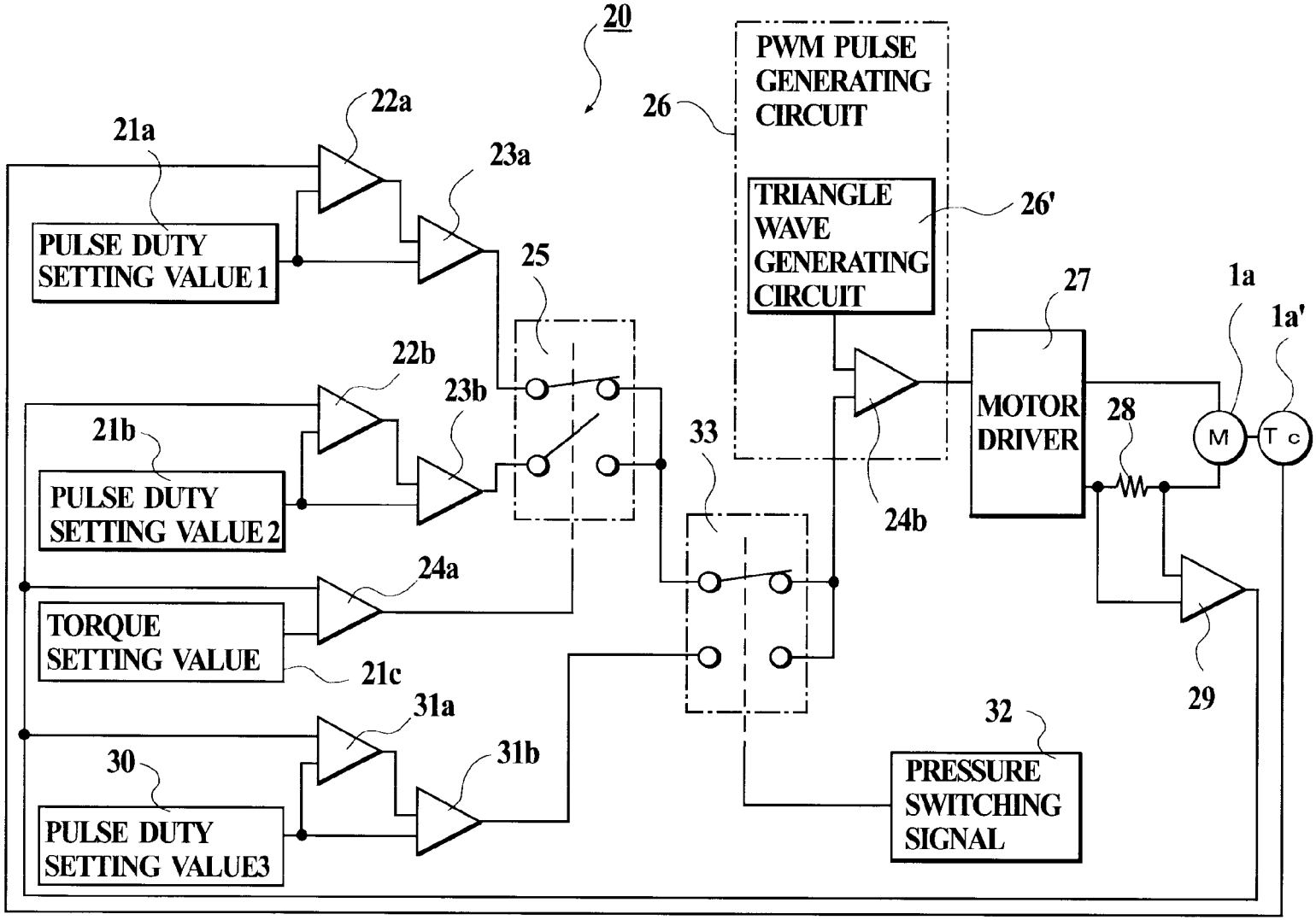
FIG. 5 is a block diagram showing a construction of the pressure control circuit according to the second embodiment.

As shown in FIG. 5, the pressure control circuit 20 has a construction that a pulse duty setting unit 30, a subtracter 31*a*, an adder 31*b*, a pressure switching signal generating unit 32 and a switch 33 are further provided in the pressure control circuit 2 shown in FIG. 2.

In the operation of the pressure control circuit 20, the operation which is different from that of the pressure control circuit 2 will be explained with reference to FIG. 5.

In this figure, the subtracter 31*a* compares the output value of the amplifier 29 with the pulse duty setting value which is stored in the pulse duty setting unit 30, and outputs a difference between the output value of the amplifier 29 and the pulse duty setting value of the pulse duty setting unit 30. An adder 31*b* generates a signal having a value obtained by adding the above difference to the pulse duty setting value.

The switch 33 outputs the generated signal to a comparator 24*b* in order to generate a comparative signal for comparing the generated signal with a triangle wave outputted from the triangle wave generating circuit 26' of the PWM pulse generating circuit 26. Thereby, the output signal is controlled so as to maintain the predetermined value set by the pulse duty setting unit 30.

In the pulse duty setting unit 30, a pulse duty setting value corresponding to a torque in which the pen 1*f* hardly applies a force to the object 6 to be marked, is previously set.

The pressure control circuit 20 controls the torque of the motor 1*a* so as to become a torque in which the pen 1*f* hardly applies a force to the object 6 to be marked, by controlling the switch 33 in accordance with the pressure switching signal outputted from the pressure switching signal generating unit 32. Therefore, when a line to be marked is not continuous, or when the pen 1*f* moves between two positions in which each character is marked on a surface, the pen 1*f* can move to the next marking position without applying a force to a surface to be processed. Further, time for moving the pen 1*f* can be shorten.

Figure 6:
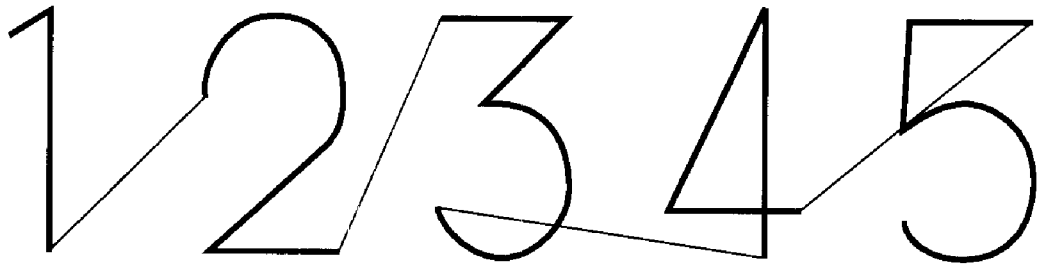
FIG. 6 is a view showing an example of the marking which is carried out by the marking device according to the second embodiment.

In FIG. 6, an example of the marking of a plurality of numbers 1 to 5, which is carried out by the marking device according to the second embodiment, is shown. In this figure, each thin line from an end point of a number to a start point of the next number, is one formed by decreasing a pressing force of the pen, stopping the vibration of the end of the marking portion, and moving the pen in two-dimensional directions, that is, along the surface to be processed.

When the pen moves to the next marking position, the end of the marking portion (stylus 1*g* ) does not applies a force to the surface to be marked, but drags on the surface. Therefore, thin lines (scratches) are formed on the surface. However, if the object to be marked does not have a clear surface like a mirror-surface, it is difficult to look for the thin lines. The thin lines does not deteriorate a quality of a marked character.

According to one aspect of the present invention, because the pressing force applied to the object to be marked is directly detected by utilizing the reactive force from the marking portion, and the pressing force can keep constant, the marking device can adjust the pressure with a simple and small structure.

Further, the marking device can mark a character or the like on the object to be marked, by moving the marking portion at the most suitable speed with the most suitable pressing force in accordance with the weight of the marking mechanism or the contact position of the surface to be processed.

Further, because a user can soon recognize that the marking mechanism is in a position that the marking portion cannot mark a character or the like on the object to be marked, it is possible to shorten marking time and to save the power.

Further, because the torque applied to the driving member keeps constant, it is possible to mark a character or the like in a uniform depth without depending on the contact position that the marking portion is in contact with the surface to be processed.

According to another aspect of the present invention, when a line to be marked is not continuous, or when the marking portion moves between two positions in which each character is marked, the marking portion hardly reciprocates. Therefore, it is possible to dramatically shorten time for the marking. Further, because time for operating the marking mechanism is shortened, it is possible to improve the durability of the marking mechanism. Therefore, the possibility of the breakdown can be improved.

The entire disclosure of Japanese Patent Application No. Tokugan 2000-116836 filed on Apr. 18, 2000 including specification, claims drawings and summary are incorporated herein by reference in its entirety.

What is claimed is:

1. A marking device comprising:

a marking portion;

a marking mechanism for marking a surface to be processed, of an object to be marked, by reciprocating the marking portion;

a marking portion moving mechanism for moving the marking portion in two-dimensional directions along the surface to be processed; and a pressure adjusting circuit for keeping a constant pressure which the marking portion applies to the surface to be processed;

wherein the marking mechanism comprises a cam, a driving member and a cam mechanism for linearly reciprocating the marking portion by following the cam which is rotated by the driving member.

2. The marking device as claimed in claim 1, further comprising a contact detecting circuit for detecting a contact between the surface to be processed and the marking portion by a change in a value of a current flowing into the driving member;

wherein when the contact between the surface to be processed and the marking portion is detected by the contact detecting circuit, the pressure adjusting circuit adjusts the pressure which is applied to the surface to be processed, in accordance with the change in the value of the current.

3. The marking device as claimed in claim 2, further comprising a warning output circuit for outputting a warning when the contact between the surface to be processed and the marking portion is not detected by the contact detecting circuit while the marking mechanism linearly reciprocates the marking portion.

4. The marking device as claimed in claim 1, wherein the cam has a cam curvature so that a torque, which is applied to the driving member by the contact between the marking portion and the surface to be processed, is kept constant without depending on a position of the contact of the surface to be processed.

5. A marking method comprising the steps of:

marking a surface to be processed, of an object to be marked, by following a cam which is rotated by a driving member to reciprocate a marking portion;

moving the marking portion in two-dimensional directions along the surface to be processed;

detecting a contact between the surface to be processed and the marking portion by a change in a value of a current flowing into the driving member; and keeping a constant pressure which the marking portion applies to the surface to be processed in accordance with the change in the value of the current, when the contact between the surface to be processed and the marking portion is detected in the detecting step.

6. The marking method as claimed in claim 5, further comprising a step of outputting a warning when the contact between the surface to be processed and the marking portion is not detected in the detecting step while the marking portion is linearly reciprocated in the marking step.

7. A marking device comprising:

a marking portion having an end that is vibrated;

a marking mechanism for marking a surface to be processed, of an object to be marked, by reciprocating the marking portion;

a marking portion moving mechanism for moving the marking portion in two-dimensional directions along the surface to be processed; and a pressure adjusting circuit for keeping a constant pressure which the marking portion applies to the surface to be processed;

wherein the pressure adjusting circuit weakens the pressure which is applied to the surface to be processed, and stops vibrating the end of the marking portion, when a line to be marked is not continuous or when the marking portion moves between two positions in which each character is marked on the surface to be marked; and the marking portion moving mechanism moves the marking portion to a next position to be marked in the two-dimensional directions in a state that the marking portion is in contact with the surface to be processed, when the line to be marked is not continuous or when the marking portion moves between the two positions.

8. A marking method comprising:

marking a surface to be processed, of an object to be marked, by reciprocating a marking portion of which an end is vibrated;

weakening a pressure which is applied to the surface to be processed, to keep the pressure constant, and stopping vibrating the end of the marking portion, when a line to be marked is not continuous or when the marking portion moves between two positions in which each character is marked on the surface to be marked; and moving the marking portion to a next position to be marked in two-dimensional directions in a state that the marking portion is in contact with the surface to be processed, when the line to be marked is not continuous or when the marking portion moves between the two positions.

9. A marking device comprising:

a marking portion;

a marking portion moving mechanism for moving the marking portion;

a reciprocating mechanism for reciprocating the marking portion;

a pressure control circuit for controlling a pressure which the marking portion applies to a surface to be marked; and wherein when the marking portion moving mechanism moves the marking portion while hardly marking the surface to be marked, the reciprocating mechanism stops reciprocating the marking portion, the pressure control circuit weakens the pressure so as to hardly mark the surface to be marked, and the marking portion is moved while being in contact with the surface to be marked.

10. A marking method comprising:

moving a marking portion;

reciprocating the marking portion;

controlling a pressure which a marking portion applies to a surface to be marked; and further moving the marking portion without marking the surface to be marked, by stopping the marking portion from being reciprocated, weakening the pressure the marking portion applies to the surface to be marked, and moving the marking portion while in a state that the marking portion is in contact with the surface to be marked.

* * * * *